United States Patent [19]

Higashinakagawa et al.

[11] Patent Number: 4,771,213

[45] Date of Patent: Sep. 13, 1988

[54] SHADOW MASK

[75] Inventors: Emiko Higashinakagawa, Kawasaki; Michihiko Inaba, Yokohama; Yasuhisa Ohtake, Fukaya; Masaharu Kanto, Hyogo; Shinzo Sugai, Chigasaki, all of Japan

[73] Assignee: Kabushiki Kaisha Toshiba, Kawasaki, Japan

[21] Appl. No.: 923,213

[22] Filed: Oct. 27, 1986

[30] Foreign Application Priority Data

Oct. 30, 1985 [JP] Japan ..... 60-243360
Mar. 31, 1986 [JP] Japan ..... 61-72986

[51] Int. Cl.[4] ..... H01J 29/07; C21D 9/46

[52] U.S. Cl. ..... 313/402; 313/364; 148/DIG. 51; 445/47; 156/644; 156/647; 156/664

[58] Field of Search ..... 313/402, 403, 407; 445/47; 148/12.1, 14, DIG. 51; 428/596; 156/644, 647, 664

[56] References Cited

U.S. PATENT DOCUMENTS 4,528,246 7/1985 Higashinakagawa et al. ..... 428/596
4,612,061 11/1986 Suzuki et al. ..... 313/402 X

*Primary Examiner*—David K. Moore

*Assistant Examiner*—Mark R. Powell

*Attorney, Agent, or Firm*—Oblon, Fisher, Spivak, McClelland & Maier

[57] ABSTRACT

A cast ingot of an invar alloy is forged, hot-and cold-rolled, annealed and subjected to a controlled rolling to provide a shadow mask plate. An X-ray diffraction pattern is formed in an electron-beam hole-formation surface of the shadow mask plate, and a draft in a controlled rolling step is so controlled that the "g" value is 2 or more. The "g" value is given as $$g=(I_1+I_2)/I_3$$

where $I_1$=the X-ray diffraction integrated intensity at the {200} crystal faces;

$I_2$=the X-ray diffraction integrated intensity at the {111} crystal faces; and $I_3$=the X-ray diffraction integrated intensity at the {220} crystal faces.

The shadow mask plate is etched to provide shadow masks each having electron-beam holes formed therein, noting that one hole surface side which has greater {100} texture is used as a larger-diameter hole surface side.

7 Claims, 5 Drawing Sheets

(100)

(110)

(111)

SHADOW MASK

BACKGROUND OF THE INVENTION

This invention relates to a shadow mask for use in a color CRT (cathode ray tube).

A shadow mask for use in a color CRT is arranged in proximity to a tri-color fluorescent screen. Electron beams emitted from electron guns pass throug a corresponding electron-beam hole in a shadow mask and land precisely on predetermined spots on the fluorescent screen. The shadow mask functions to permit the electron beam to be directed onto the fluorescent screen. For this reason, the relative position, diameter, and configuration of the electron-beam holes directly influence the resultant image quality, and a high manufacturing accuracy, therefore, is required when forming the electron-beam holes. Low manufacturing accuracy would lead to the degeneration of image quality, resulting from a "doming" phenomenon. In order to prevent the generating of scattering electrons, use of a special process is required which makes the beam-exit surface side of each electron beam hole larger than its beam-entry surface side, and thus makes the electron-beam hole semispherical in configuration.

Conventionally, high manufacturing accuracy of the electron beam holes has been achieved by etching a shadow mask plate with a predetermined etchant, to form electron-beam holes.

Recently, due to widespread demand for television pictures having "fineness of texture", a high quality television system is being developed as a communication system. The high quality television system requires a CRT having improved image resolution. In order to improve image resolution, it is necessary to form the electron-beam holes of a shadow mask more finely, and achieve a high density thereof.

In order to provide very fine, high-density electron-beam holes in the shadow mask, it is required that they be formed with higher accuracy than has been required in the case of the conventional CRT. However, the electron beams tend also to strike the area surrounding the individual beam holes, which causes the shadow mask to become heated and to expand, with the result that the electron-beam holes become somewhat displaced from their proper positions to cause a new problem of occurrence of a color deviation phenomenon called "purity drift" (hereinafter referred to as "PD"). An invar type alloy of a low thermal expansion coefficient has been used for the shadow mask so as to lower the PD value. In this case, it has, however, proved difficult to form electron-beam holes by use of a conventional etching method, because the invar type alloy has a high resistance to etching. Consequently, even if it is possible to form electron-beam holes in this alloy, it is difficult to form them with the required high accuracy.

In connection with this problem, the inventors demonstrated, in U.S. Pat. No. 4,528,246, the concept of forming fine electron-beam holes on a shadow mask plate with better accuracy by forming {100} crystal faces, by rolling and heating, the mask plate surface to have the {100} texture of 35% or more. Here, an f value has been adopted as a parameter the {100} texture on the surface of the shadow mask. However, it could be that the accuracy with which the electron-beam holes are made may be inadequate, thus making it difficult to evaluate such an "f" value, the parameter of the {100} texture.

SUMMARY OF THE INVENTION

It is accordingly the object of this invention to provide a shadow mask having electron-beam holes formed more finely and with a higher density than in the conventional CRT.

According to an aspect of this invention, a shadow mask for a color cathode ray tube is provided, which comprises a plate-like body made of an invar type alloy of a face-centered cubic lattice structure and having holes through which electron beams from electron guns pass, in which, in an X-ray diffraction at both the surface sides which, the plate-like body has the "g" value of 2 or more at both surfaces. The "g" value is given as:

$$g=(I_1+I_2)/I_3 \text{ where}$$

$I_1$=the X-ray diffraction integrated intensity of the {200} crystal faces;

$I_2$=the X-ray diffraction integrated intensity of the {111} crystal faces;

$I_3$=the X-ray diffraction integrated intensity of the {220} crystal faces.

According to another aspect of this invention, a shadow mask for a color cathode ray tube is provided, which comprises a plate-like body made of an invar type alloy of a face-centered cubic lattice structure and having holes through which electron beams pass, in which said shadow mask is made of an alloy of a face-centered cubic lattice structure, the electron-beam holes are so formed that each is larger in diameter at the electron beam-exit side than at the electron beam-entry side, and the {100} texture of the electron beam-exit surface is greater than that of the electron beam-entry surface.

The inventors have found that improper configuration and inexact relative positioning of electron-beam holes in the shadow mask are responsible for nonuniformity in the orientation of crystal faces on a shadow mask surface.

That is, where electron-beam holes are formed by etching in the shadow mask plate made of an invar type alloy of a face-centered cubic lattice structure, they can be formed with high accuracy if the {100} and {111} texture is great on the etching surfaces. If, however, the {110} texture is great, then elliptical holes will be formed in the course of etching, thus failing to form circular electron-beam holes with high accuracy. The texture of a crystal face can be shown using X-ray diffraction integrated intensity. The higher the {100} and {111} texture, the greater the diffraction integrated intensities $I_1$ and $I_2$ and, conversely, the higher the {110} texture crystal faces, the higher the diffraction intensity $I_3$. Thus, the greater the "g" value indicated by $(I_1+I_2)/I_3$, the higher the accuracy with which electron-beam holes are formed. When the "g" value is set to be 2 or more, the electron-beam holes can be made very small, and can be arranged in a and with a high density, thereby enabling better imag4e quality to be obtained.

The inventors have found that the {100} texture varies at the surfaces (obverse and reverse surfaces) of a shadow mask plate. In order to prevent the generating of scattering electrons, the electron-beam holes are so formed that their diameters are greater at the beam-exit surface side than at the beam-entry surface side. For this reason, a greater amount of working is required at the beam-exit surface side than at the beam-entry surface side. Therefore, if one shadow-mask surface which has the {100} texture greater than that of another surface is used as the beam-exit surface side of the shadow mask plate, then high accuracy can be attained at that surface side of the shadow mask plate where a greater amount of working is required and thus, it is possible to form the electron-beam holes with high accuracy.

DETAILED DESCRIPTION OF THE PREFERRED EMBODIMENTS

A shadow mask according to one embodiment of this invention will now be described below, with reference to the accompanying drawings.

Figure 1:
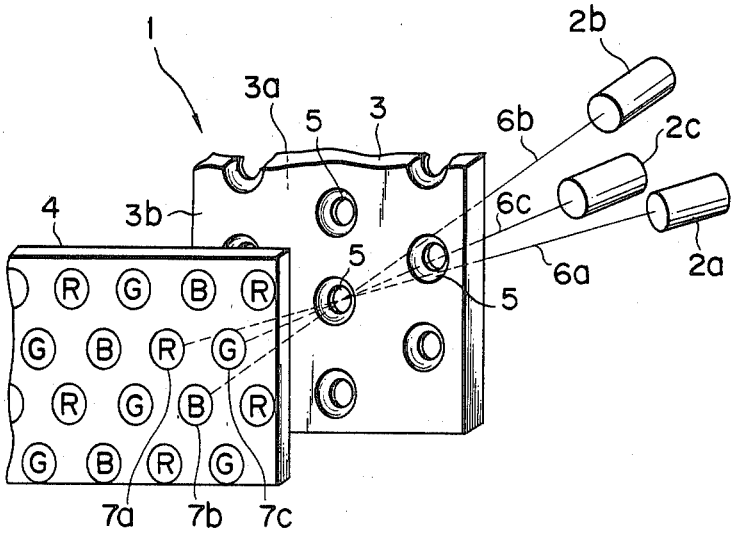
FIG. 1 is a perspective view showing a color CRT using a shadow mask according to one embodiment of this invention.

FIG. 1 is a perspective view showing a color TV CRT using a shadow mask according to an embodiment of this invention. The TV CRT comprises electron guns *2a, 2b,* and *2c,* shadow mask 3, and fluorescent screen 4. Shadow mask 3 is located between the electron guns and fluorescent screen 4. A plurality of electron-beam holes are formed in shadow mask 3, and extend from beam-entry surface *3a* to beam-exit surface *3b*. Red, blue, and green beams *6a, 6b,* and *6c,* respectively, are emitted from electron guns *2a, 2b,* and *2c* and are directed as beam spots onto red, green, and blue fluophors *7a, 7b,* and *7c* on fluorescent screen 4, through corresponding electron-beam holes.

Figure 2:
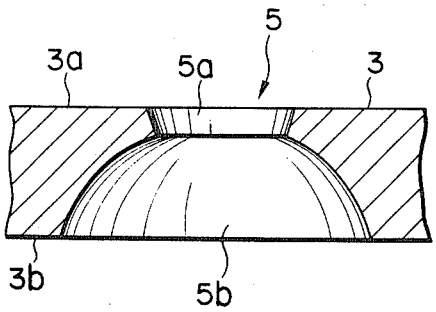
FIG. 2 is a cross-sectional view, partly enlarged, showing electron-beam holes in the shadow mask.

FIG. 2 is an enlarged, cross-sectional view showing one of the aforementioned electron-beam holes which are formed in shadow mask 3. Electron-beam hole 5 is comprised of a frusto-conical input section *5a* formed on the electron beam-entry and semispherical output section *5b* formed at the beam-exit, with a pinched portion defined betwen these sections. Electron-beam hole 5 is so formed that electron beam-exit surface *3b* of output section *5b* has a greater diameter than electron beam-entry surface *3a* of input surface *5a*. By widening the electron-beam hole at output section *5b*, in this case, the scattering of electron beams is prevented, thereby offering improved image quality.

In the color CRT so arranged, respective electron beams *6a, 6b,* and *6c* are directed onto the corresponding fluophors *7a, 7b,* and *7c,* to allow the emission of the respective colored light beams. Shadow mask 3 allows the passage of electron beams of the respective colors, so that the respective electron beams are directed precisely onto predetermined locations on the fluorescent screen. It is therefore necessary that the electron-beam holes of shadow mask 3 be formed with high manufacturing accuracy.

Shadow mask 3 is made of an invar type alloy of a face-centered cubic lattice structure. The face-centered cubic lattice structure facilitates easy orientation of the crystal faces and, in the formation of electron-beam holes 5, those crystal faces can be favorably utilized to provide electron-beam holes with adequate dimensional and positional accuracy. Usable invar type alloys of a face-centered cubic lattice structure are, for example, an invar alloy (36Ni-Fe), super invar steel (32Ni-5Co-63Fe), invar stainless steel (54Co-9.3Cr-36.5Fe), and 43Pb-63F alloy. These alloys all have a low thermal expansion coefficient, as is set forth above, and even if the shadow mask is heated up, almost no color drift, resulting from the thermal expansion of shadow mask 3, occurs, not does a resultant change in the position and configuration of electron-beam holes 5. It is preferable that shadow mask 3 be made of an erinvar type alloy with a predetermined tensile stress applied thereto, in which case, a shadow mask 3 undergoes no substantial expansion as a result of a rise in the temperature thereof.

Figure 3:
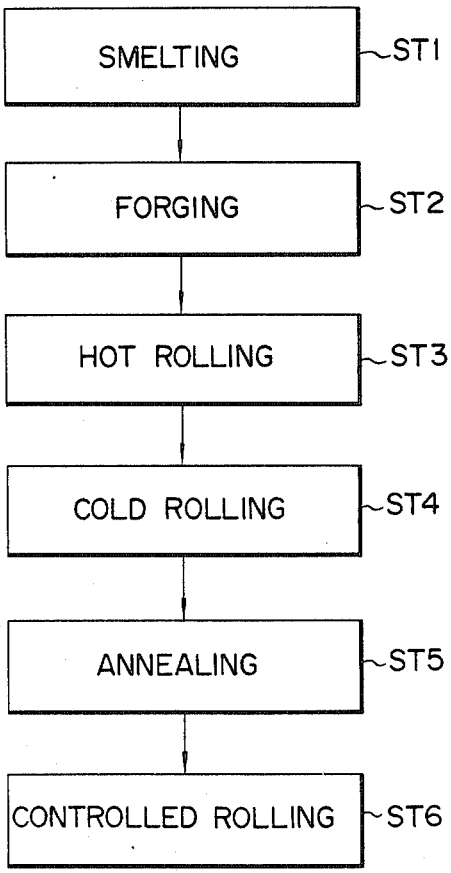
FIG. 3 is a block diagram showing one of the manufacturing processes used in forming a shadow mask sheet.

The process of manufacturing a shadow mask plate according to the present invention will now be explained below, with reference to FIG. 3.

First, the aforementioned alloy is melted and cast, in step 1, to provide an ingot. In step 2, the ingot is forged and, in step 3, is rolled, by use of a continuous hot-rolling process, into a 2 mm-thick plate. As a result of the hot-rolling process, the rolled plate has the {100} texture on the rolled faces. Then, in step 4, the sheet is cold-rolled once, or a plurality of times, with a draft of 80% or more (for example 90%), to obtain a sheet having a t hickness of, for example, 0.2 mm. This cold-rolling step allows the crystal axis to rotate, so that the rolled plate has the {110} texture on the rolled faces. Then, in step 5, the plate so obtained is annealed at a temperature exceeding a recrystallization temperature, so that the plate has the {100} texture on the rolled faces again. Thereafter, in step 6, the plate is cold-rolled by use of a controlled rolling step with a predetermined draft, and its shape, etc. is corrected, to thereby obtain a shadow mask sheet.

Figure 4:
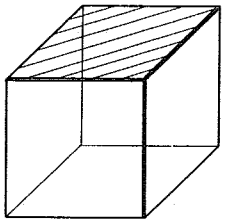
FIGS. 4 to 6 each show a modeling diagram of a face-centered cubic lattice structure.
Figure 5:
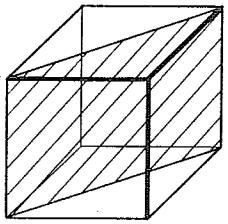
Figure 6:
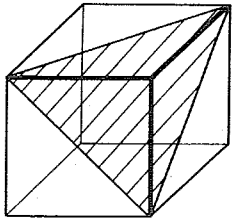
Figure 7:
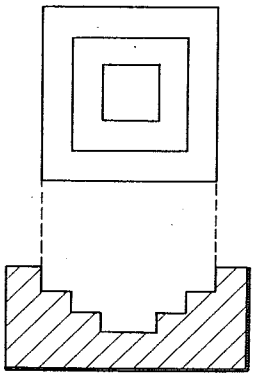
FIGS. 7 to 9 are each a modeling diagram showing an etching progress at a crystal plane of a shadow mask plate.
Figure 8:
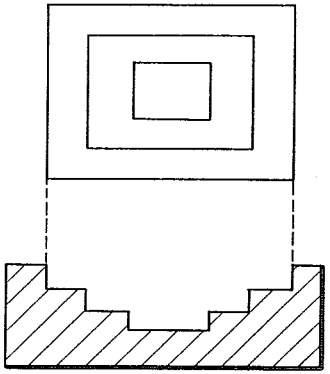
Figure 9:
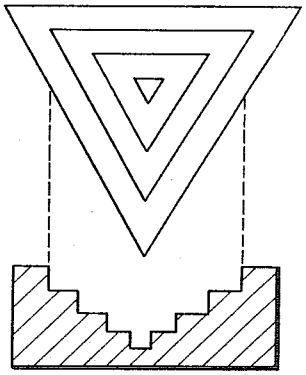
Figure 10:
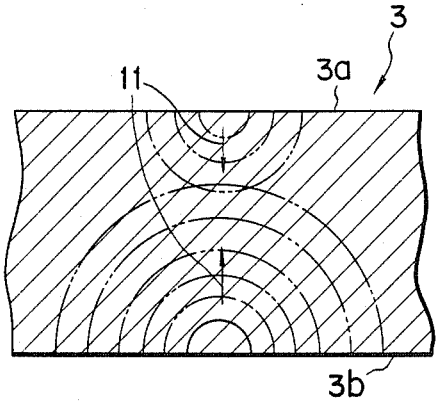
FIG. 10 is a modeling diagram showing an etching direction when an electrpon-beam hole-formation surface of a shadow mask plate has the {100} or {111} texture.
Figure 11:
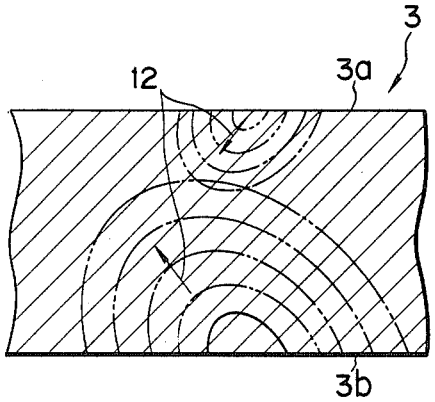
FIG. 11 is a modeling diagram showing an etching direction when an electron-beam hole-formation surface of a shadow mask plate has the {110} texture.

Shadow mask 3 is manufactured by forming electron-beam holes 5 in the surface of the rolled shadow mask plate. Specifically, electron-beam holes 5 are formed by etching both surfaces of the shadow mask plate. The accuracy with which the electron-beam holes are formed varies depending upon the crystal faces of the emerging rolled-surface of the plate. As is set forth above, the shadow mask is made of an alloy of a face-centered cubic lattice structure and has {100}, {110}, and {111} crystal faces, as is shown in FIGS. 4, 5 and 6, respectively. Since the {100} crystal face emerges on the etched surface of the plate, isotropic etching progresses, as is shown in FIGS. 7 and 9, with the {100} and {111} texture. The etching direction is perpendicular to the rolled surface, as is indicated by arrows in FIG. 10. With the rolled surface of the plate having the {100} and {111} texture, it is possible to form very fine holes with high accuracy. With the plate having the {100} texture on the rolled surfaces, as is shown in FIG. 8, the longitudinal and lateral etchings differ from each other with respect to their etching rate, offering an elliptical hole configuration. As a result, the etching direction will be inclined with respect to the rolled surface, as is indicated by arrows 12 in FIG. 11. With the plate having the {110} texture on the rolled surfaces, it is difficult to form very small holes with high accuracy. In the rolled surfaces of the shadow mask plate, the accuracy with which electron-beam holes 5 are made can be enhanced through the {100} and {111} texture being greater and the {100} texture being lower.

The {100} and {111} texture can be evaluated by taking an X-ray diffraction pattern on the rolled surface of the shadow mask plate. In the actual evaluation of the X-ray diffraction, the diffraction integrated intensity at the {200} crystal face corresponds the {100} texture, and the diffraction integrated intensity at the {220} crystal face corresponds to the the {110} texture. With the diffraction integrated intensities of the {200}, {111}, and {220} crystal faces indicated by $I_1$, $I_2$, and $I_3$, respectively, the "g" value representing the {100} and {111} texture on the rolled surface of the shadow mask plate can be expressed by Equation (1) below.

$$g=(I_1+I_2)/I_3 \quad (1)$$

The "g" value varies, depending upon the draft of the controlling rolling. The greater the "g" value, the smaller the draft.

The relation of the "g" value to image quality ion will be explained below.

Figure 12:
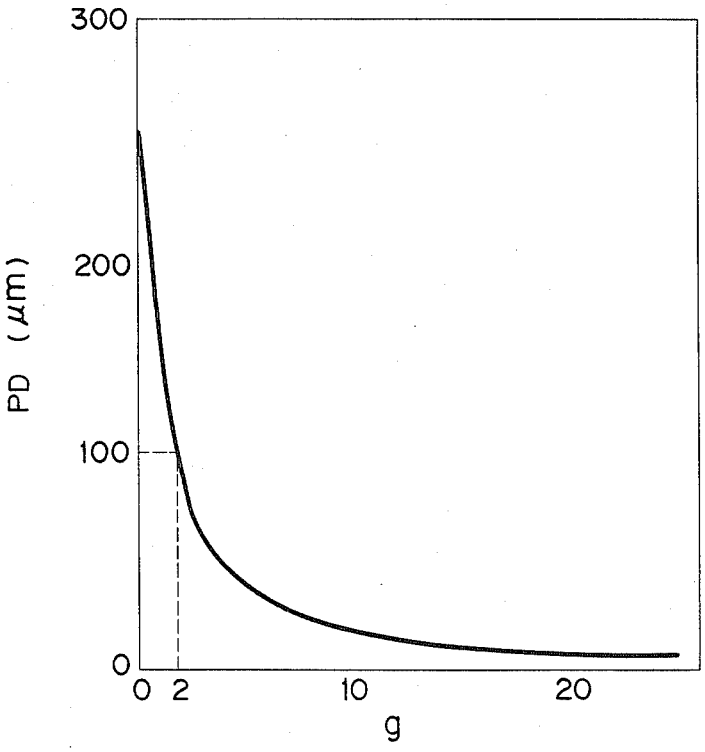
FIG. 12 is a graph showing a relation of a PD value to a "g" value.

FIG. 12 is a graph showing a relation of the "g" value as the abscissa, to a PD value as the ordinate. Here, the PD value indicates the extent iof color drift, μm, arising from a relative positional relation of electron-beam hole 5 in shadow mask 3, to fluorescent screen 2. The smaller the PD value, the lesser the extent of color drift and vice-versa. In FIG. 12, if the "g" value becomes smaller than 2, the PD value increases sharply and exceeds 100 μm. When the "g" value becomes smaller than 2, then, a drastic color drift occurs, indicating a lower manufacturing accuracy in the forming of electron-beam holes 5 in shadow mask 3, and thus prominently lowering image quality. When, on the other hand, the "g" value exceeds 2, color drift decreases at the shadow mask thus, indicating the high manufacturing accuracy with which the electron-beam holes are formed. As a result, better image quality is obtained. The "g" value is 2 or more, it is possible to form very small electron-beam holes in the shadow mask, with high accuracy, and thus to obtain improved image quality.

This embodiment will now be explained below, in connection with the following example:

EXAMPLE 1

An invar alloy (36Ni-Fe) was melted and cast then cast so as to provide an ingot. After being forged, the ingot was rolled, by use of a continuous hot-rolling process, into a 2 mm-thick plate. The sheet was further cold-rolled into a 0.2 mm-thick plate, with a 90% draft. Then the plate was annealed at 750° C., a temperature exceeding the recrystallization temperature, and the annealed plate was subjected, as required, to a controlled rolling, to thereby produce a shadow mask plate.

After each of these steps, an X-ray diffraction pattern was taken from the surface of the rolled sheet, and the "g" value was calculated from the pattern after the sheet was hot-rolled, the "g" value was 13. After a cold working, the "g" value was 0.5, and after the step subsequent to the cold working, it was 108.

Figure 13:
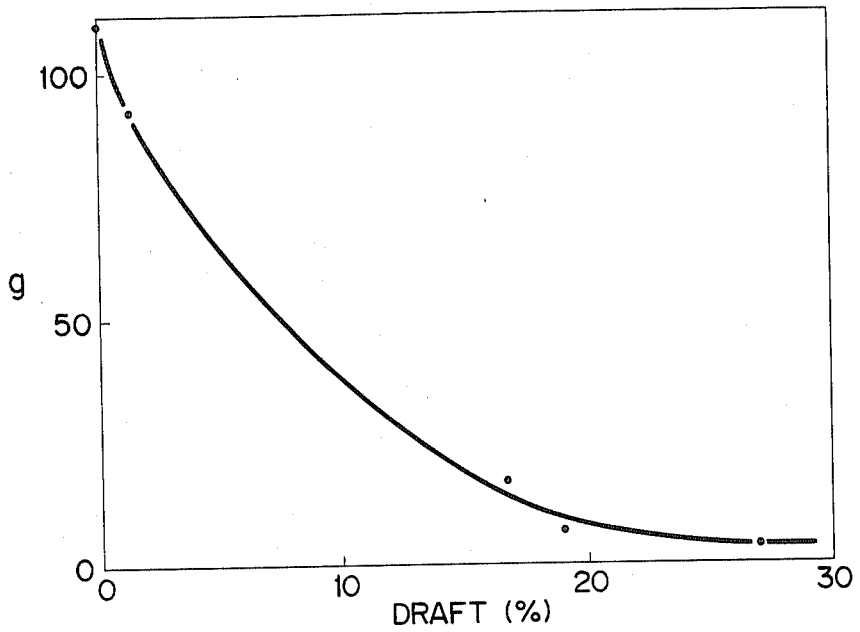
FIG. 13 is a graph showing a relation between a "g" value to draft of a controlling rolling.

FIG. 13 is a graph showing a relation of the draft used in a controlled rolling step, to the "g" value, with the draft plotted as the ordinate, and the "g" value as the abscissa. As can be seen from the graph of FIG. 13, in the controlled rolling step, there is a tendency wherein the higher the draft, the lower the "g" value. The "g" value was 87 for 4.8% draft, 26 for a 16.7% draft, 5 for a 19% draft, and 2.2 for 27% draft.

Figure 14:
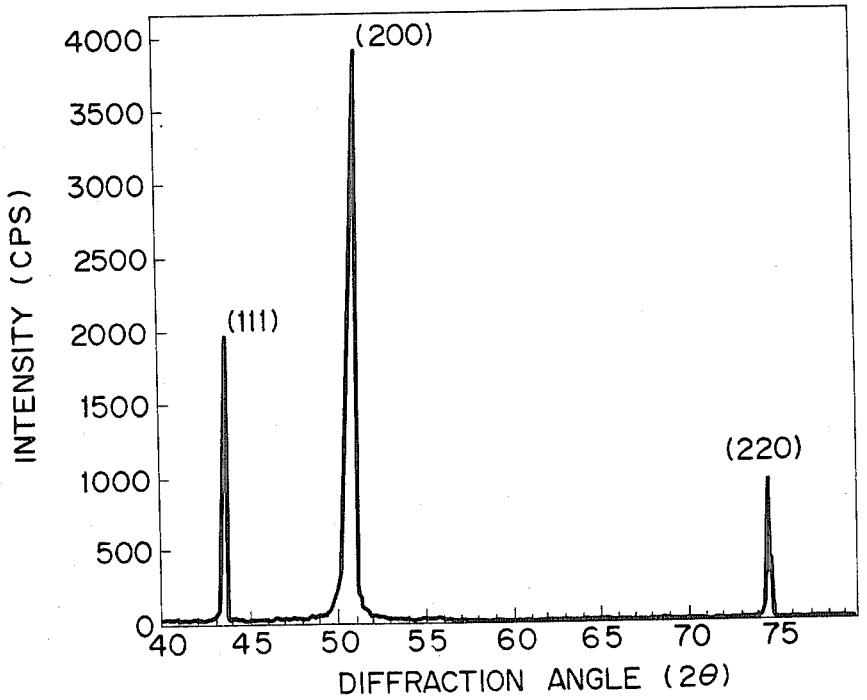
FIG. 14 is a graph showing an X-ray diffraction pattern for an electron-beam hole-formation surface of a shadow mask sheet.

Next, an X-ray diffraction pattern was taken from the surface of the rolled shadow mask sheet. FIG. 14 shows the above X-ray diffraction pattern when the draft at the controlled rolling step was 4.8%. As the X-ray, a kα ray from copper was used with an acceleration voltage of 50 kV and an electric current of 30 mA, noting that as a definer of the diffraction integrated intensity of the X-ray, use was made of a value corresponding to the area of each peak value in the graph of FIG. 14.

A shadow mask sheet having a "g" value of below 2, that is, a draft of below 30% in the controlled rolling step, was thus manufactured, this being followed by the placing of an etchant onto both surfaces of the sheet (the beam-entry side and beam-exit side in FIG. 2), to thereby provide electron-beam holes 5. As the etchant, an aqueous solution containing 43% ferric chloride, 6% ferrous chloride, and 0.1% hydrochloric acid was used, this being applied at a temperature of 65° C. As a result, 520,000 electron-beam holes 5 were formed at a pitch of 0.3 mm in the shadow mask plate, thereby providing a shadow mask for a 14" type television CRT. It has been confirmed that the electron-beam holes thus formed have excellent manufacturing accuracy and that the shadow mask having these electron-beam holes provides excellent image quality with minimal color drift.

Another embodiment of this invention will now be explained below.

In the shadow mask plate thus manufactured by the steps of the first embodiment, the "g" value varies at both surfaces.

As has been set out above, an etchant was placed on both surfaces (beam-entry and beam-exit surfaces) of shadow mask 3, to thereby form a beam input section 5*a* and a beam output section 5*b* at each electron-beam hole 5. In order to prevent the generating of scattering electrons, electron-beam hole 5 is formed so that beam output section 5*b* is larger in diameter than beam input section 5*a*. For this reason, a greater amount of working is required at the beam output section side than at the beam input section of the shadow mask. As is set out above, the greater the "g" value, the higher the manufacturing accuracy. If the shadow mask side whose "g" value is greater than that of the other side of the shadow mask is used as that side of the shadow mask which requires a greater amount of working, then it is possible to enhance the manufacturing accuracy of the electron-beam hole 5.

In the respective rolling and annealing steps involved in the manufacturing of the shadow mask plate, the {100} and {110} texture varies principally at the shadow mask surfaces. In place of the "g" value, therefore, the "a" value, as indicated by Equation (2) below, can be employed as the parameter of the manufacturing accuracy.

$$a = I_1/I_3 \quad (2)$$

The "a" value can be employed in the same way as the "g" value. That is, if the shadow mask surface side whose "a" value is greater than that of the other side surface of the shadow mask is used as that side of the shadow mask which requires a greater amount of working, then it is possible to enhance the manufacturing accuracy of the electron-beam hole 5.

This embodiment will now be explained below in more detail, with reference to the following example:

EXAMPLE 2

A shadow mask sheet was manufactured in the same manner as in Example 1, using an invar alloy. The shadow mask sheet was wound around a take-up roll for storage. Table 1 below shows the "g" value of both sides (surfaces) of the shadow mask sheet.

TABLE 1

| Sample No. | Surface | |
|---|---|---|
| | Surface A | Surface B |
| 1 | 53.8 | 22.5 |
| 2 | 51.7 | 20.9 |
| 3 | 127.4 | 16.7 |
| 4 | 41.3 | 27.0 |
| 5 | 32.3 | 12.7 |
| 6 | 147.2 | 20.3 |

In Table 1, surface A was used as the surface whose "g" value is higher, and surface B as the surface whose "g" value is lower.

Similarly, the "a" value was, for example, 30 at surface A and 20 at surface B.

In the shadow mask plate, electron-beam hole 5 was formed, as in Example 1, such that the shadow mask plate surface side whose "g" or "a" value is greater than that of the other surface side of the shadow mask plate is used as the plate side which requires the greater amount of working. As a result, it was possible to obtain electron-beam holes 5 with a high manufacturing accuracy.

Electron-beam holes 5 were formed with the beam output side as surface A when the "a" value was, for example, 30 at surface A and 20 at surface B, in which case the PD value was 25 $\mu$m. When electron-beam hole 5 was formed with surfaces A and B interchanged, the PD value was then 50 $\mu$m. From this it will be appreciated that the advantage of this embodiment is clear, since the PD value was 25$\mu$.

Although in the aforementioned embodiment the electron-beam holes have been explained as being circular, this invention is not restricted thereto. For example, the electron-beam holes may be so formed as to be of a wide or narrow slot type.

We claim:

1. A shadow mask for a color cathode ray tube, comprising a plate-like body made of an invar type alloy of a face-centered cubic lattice structure, and having holes through which electron beams from electron guns pass said plate-like body has the "g" value of 2 or more at both surfaces where "g" is given as:

$$g = (I_1 + I_2)/I_3$$

where $I_1$ = the X-ray diffraction integrated intensity of the {200} crystal faces of said alloy;

$I_2$ = the X-ray diffraction integrated intensity of the {111} crystal faces of said alloy; and $I_3$ = the X-ray diffraction integrated intensity of the {220} crystal faces of said alloy.

2. The shadow mask according to claim 1, in which said electron-beam holes are so formed that each is smaller in diameter at one surface side of said body than at the other surface side of said body.

3. The shadow mask according to claim 2, in which said electron-beam holes are so formed that one surface side whose "g" value is greater than that of the other surface side is used as a surface side in which the beam hole diameter is larger than that of the other surface side.

4. The shadow mask according to claim 2, in which said electron-beam holes are formed such that one surface wherein the beam hole diameter is greater than that of the other surface, has a higher texture of the {100} and {111} crystal faces than the other surface.

5. The shadow mask according to claim 2, in which electron beams which have been emitted from said electron guns pass through the shadow mask, from a smaller-diameter side of said electron-beam holes.

6. The shadow mask according to claim 4, in which the surface of said shadow mask having a greater "g" value is used as an electron-beam-exit surface.

7. A shadow mask for a color cathode ray tube, comprising a plate-like body made of an invar type alloy of a face-centered cubic lattice structure, and having holes through which electron beams from electron guns pass, in which said electron-beam holes are so formed that each is larger in diameter at an electron beam-exit surface side than at an electron-beam-entry surface side, and the {100} texture of the electron beam-exit surface is greater than that of the electron beam-entry surface, said {100} texture being given "a" value which is given by:

$a = I_1/I_3$ where $I_1$ is the X-ray diffraction integrated intensity at the {200} crystal faces and $I_3$ is the X-ray diffraction integrated intensity at the {220} crystal surfaces, and where the surface of said shadow mask having a greater "a" value is used as an electron beam-exit side.

* * * * *